US006276133B1

(12) United States Patent
Yoshida et al.

(10) Patent No.: US 6,276,133 B1
(45) Date of Patent: Aug. 21, 2001

(54) PRESSURE FLUID SUPPLY AND DELIVERY APPARATUS

(75) Inventors: Nobumi Yoshida; Hiroshi Endo, both of Tochigi (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/392,225

(22) Filed: Sep. 9, 1999

(30) Foreign Application Priority Data

Sep. 14, 1998 (JP) ..... 10-259751

(51) Int. Cl.[7] ..... F15B 11/00
(52) U.S. Cl. ..... 60/421; 60/452; 60/486
(58) Field of Search ..... 60/421, 422, 426, 60/450, 452, 486; 91/458, 468

(56) References Cited

U.S. PATENT DOCUMENTS

| | | | | |
|---|---|---|---|---|
| 3,720,059 | * | 3/1973 | Schurawski et al. | 60/421 |
| 3,922,855 | * | 12/1975 | Bridwell et al. | 60/421 |
| 3,994,133 | * | 11/1976 | Pfeil et al. | 60/422 |
| 3,994,571 | * | 11/1976 | Johnson | 60/422 |
| 3,998,053 | * | 12/1976 | Johnson | 60/422 |
| 4,422,290 | * | 12/1983 | Huffman | 60/422 X |
| 4,461,148 | * | 7/1984 | Krusche | 60/421 |
| 4,570,441 | * | 2/1986 | Yoshida et al. | 60/421 |
| 4,586,330 | * | 5/1986 | Watanabe et al. | 60/421 |
| 4,633,666 | * | 1/1987 | Karakama | 60/421 |
| 4,759,183 | * | 7/1988 | Kreth et al. | 60/422 |
| 5,211,014 | * | 5/1993 | Kropp | 60/421 |
| 5,271,227 | * | 12/1993 | Akiyama et al. | 60/422 |
| 5,829,252 | * | 11/1998 | Hirata et al. | 60/421 |
| 5,852,934 | * | 12/1998 | Chung et al. | 60/421 |
| 5,970,709 | * | 10/1999 | Tohji | 60/421 |
| 6,170,261 | * | 1/2001 | Ishizaki et al. | 60/421 |
| 6,176,083 | * | 1/2001 | Ikari | 60/422 |

* cited by examiner

*Primary Examiner*—John E. Ryznic
(74) *Attorney, Agent, or Firm*—Armstrong, Westerman, Hattori, McLeland & Naughton, LLP.

(57) ABSTRACT

An improved pressure fluid supply and delivery apparatus is disclosed that has a pressure compensating function and yet a reduced loss in pressure. The apparatus includes a variable displacement hydraulic pump unit(10; 60, 61) having a plurality of fluid discharge ports(10*a*, 10*b*; 60*a*, 61*a*) independent each other and a common drive shaft. A plurality of fluid circuits (11, 12) are connected to the plural discharge ports (10*a*, 10*b*; 60*a*, 61*a*), respectively, and a plurality of fluid operated actuators (14, 16; 14, 14', 16, 16') are connected via respective operating valves (13, 15; 13, 13', 15, 15') to the plural fluid circuits (11, 12), respectively. Also included in the apparatus is a displacement control means (19, 20; 64, 64) operable in response to discharge pressures in the fluid discharge ports (10*a*, 10*b*; 60*a*. 61*a*) and load pressures in the actuators (14, 16; 14, 14', 16, 16') for controlling discharge fluid pressure of the variable displacement pump unit (10; 60, 61). A combining valve means (21) is disposed between the plural fluid circuits (11, 12), for blocking fluid communication between them when the plural fluid discharge ports (10*a*, 10*b*; 60*a*, 61*a*) have an equal pressure and operable to establish fluid communication between these fluid circuits via a constriction (24) in the presence of a difference in pressure between those fluid discharge ports.

12 Claims, 7 Drawing Sheets

PRESSURE FLUID SUPPLY AND DELIVERY APPARATUS

TECHNICAL FIELD

The present invention relates to a pressure fluid supply and delivery apparatus that is adapted to supply and deliver pressure fluid into a plurality of fluid operated actuators having different loads or load pressures, or to feed such actuators with pressure fluid delivered or distributed. In particular, the invention relates to improvements in such a pressure fluid supply and delivery apparatus.

BACKGROUND ART

A conventional apparatus of the type described is shown in FIG. 7.

The apparatus shown includes a hydraulic pump 1 having a discharge or delivery passage la to which a first and a second operating valve 1 and 3 are connected in parallel with each other. The first operating valve 2 has a first fluid operated actuator 4 connected thereto via a pressure compensating valve 6. Likewise, the second operating valve 3 has a second fluid operated actuator 5 connected thereto via a pressure compensating valve 6'. A shuttle valve 7 is also connected as shown for selectively sensing the one of the respective load pressures (maximum load pressure) in the actuators 4 and 5 that is higher than the other. The maximum load pressure sensed by the shuttle valve is imported into the pressure compensating valves 6 and 6'.

The pressure compensating valves 6 and 6' have a set pressure determined by a maximum load pressure that develops in the actuators 4 and 5. The pressure compensating valves 6 and 6' on the set pressure determined operates to maintain constant the difference in pressure across the inlet and outlet sides of each of the first and second operating valves 2 and 3. This permits the first and second actuators 4 and 5 to be fed with pressure fluid in respective volumetric flows proportioned in accordance with the amounts of operation for (thus the openings in) the first and second operating valves 2 and 3.

In the prior pressure fluid supply and delivery apparatus described above, if, for example, the second actuator 5 is lower in load while the first actuator 4 is higher in load, the pressure compensating valve 6' on the low load side becomes smaller in the area of opening than the pressure compensating valve 6 on the higher load side. As a consequence, with a given pressure of fluid discharged from the hydraulic pump 1 prevailing up to both the pressure compensating valves 6 and 6', a large loss (loss in pressure) develops in the fluid of an elevated pressure that passes through the pressure compensating valve 6' on the lower load side.

DISCLOSURE OF THE INVENTION

It is accordingly an object of the present invention to provide an improved pressure fluid supply and delivery apparatus that has a pressure compensating function and yet has a reduced loss (loss in pressure).

This and other objects which will become more readily apparent hereinafter are attained in accordance with the present invention by a pressure fluid supply and delivery apparatus which comprises: a variable displacement hydraulic pump unit having a plurality of fluid discharge ports independent each other and a common drive shaft; a plurality of fluid circuits connected to the said plural discharge ports, respectively; a plurality of fluid operated actuators connected via respective operating valves to the said plural fluid circuits, respectively; a displacement control means operable in response to discharge pressures in the said plural fluid discharge ports and load pressures in the said plural actuators for controlling discharge fluid pressure of the said variable displacement hydraulic pump unit; and a combining valve means disposed between the said plural fluid circuits and operable to block fluid communication between the said plural fluid circuits when the said plural fluid discharge ports have an equal pressure and operable to establish fluid communication between the said fluid circuits via a constriction when a difference in pressure develops between the said fluid discharge ports.

As the improved apparatus is so constructed as described above, those pressures develop respectively in the plural discharge ports which are independent of each other and that correspond to external loads for the respective actuators. A difference developing between load pressures in the plural actuators causes the combining valve to take its position of fluid communication to allow the plural fluid circuits to communicate with each other via a constriction. Thus, if pressure fluid is being supplied and delivered concurrently into a first actuator having a lower load pressure and with a larger volumetric flow required and a second actuator having a higher load pressure and with a smaller volumetric flow required, a portion of fluid being supplied and delivered into the second actuator is shunted and supplemented into fluid being supplied and delivered into the first actuator via the constriction. If pressure fluid is being supplied and delivered concurrently into fluid being supplied and delivered into a first actuator having a lower load pressure and with a smaller volumetric flow required and a second actuator having a higher load pressure and with a larger volumetric flow required, the combining valve is simply switched to take its fluid blocking position and its position of fluid communication alternately.

A plurality of actuators are therefore allowed to operate simultaneously with fluid of pressure compensated for in a reduced loss in pressure while satisfying volumetric flow requirements for the plural operating valves.

Specifically in the improved construction described above, the said plural fluid operated actuators may be connected in parallel to each of the said plural fluid circuits via a plurality of operating valves and a plurality of pressure compensating valves, respectively. Then, the said plural pressure compensating valves connected to each of the said plural fluid circuits may have a set pressure determined by a highest of the load pressures in said actuators connected to each of said plural fluid circuits.

As the improved apparatus is so specifically constructed as described above, a parallel connection of a plurality of actuators is established to each of the plural fluid circuits via respective operating valves and respective pressure compensating valves. The plural pressure compensating valves connected to each of the fluid circuits have a compensating pressure level established by a highest of the load pressures in the plural actuators connected to each of the fluid circuits.

This specific apparatus arrangement permits the actuators more in number than the number of the fluid circuits to be operated simultaneously.

Preferably in the first mentioned improved apparatus construction, the said variable displacement hydraulic pump unit has a plurality of groups of cylinder bores with the groups consisting of a plurality of cylinder bores formed in a plurality of concentric circular arrangements in a cylinder block of a swash plate hydraulic pump, positioned closer to its outer and inner peripheries, respectively, and a plurality of sets of pressure ports with the sets consisting of a plurality of high pressure ports and a plurality of low pressure ports formed in a plurality of concentric circular arrangements in a valve plate, positioned closer to its outer and inner peripheries, respectively.

Alternatively, the said variable displacement hydraulic pump unit comprises a plurality of hydraulic pumps of variable displacement type, having their respective drive shafts mechanically coupled together and their respective displacement control members connected to each other so that these plural hydraulic pumps have an identical displacement.

Preferably in the improved apparatus constructions described above, the said combining valve includes a spring, a first pressure receiving portion connected to one of the said plural fluid circuits, and a second pressure receiving portion connected to another of the said plural fluid circuits, the said combining valve being operable to take its fluid blocking position with a spring force of the said spring acting thereon, its first position of fluid communication with a pressure applied to the said first pressure receiving portion and its second position of fluid communication with a pressure applied to the said second pressure receiving portion.

This preferred improved apparatus construction permits the combining valve to be directly switchably operated in response to an in-circuit pressure, thus providing for a reliable switching operation and an excellent signal responsibility.

In the improved apparatus constructions described above, it is alternatively preferred that the said combining valve include a spring and a solenoid so as to be operable to take its fluid blocking position with a spring force of the said spring and its position of fluid communication with an external signal furnished to the said solenoid, there being further provided: a first and a second sensor for sensing a pressure in one of the said plural fluid circuits and a pressure in another of said plural fluid circuits, respectively; and a controller operable in response to development of a difference between the pressures sensed by said first and second sensors for furnishing the said solenoid with the said external signal.

This preferred improved apparatus construction by using a controller permits the timing for switching the combining valve to be established at any suitable moment as desired.

In the improved apparatus constructions described above, it is also preferred that the said displacement control means be constructed and arranged to be operable in response to a highest of the discharge pressures in the said plural fluid discharge ports and a highest of the load pressures in the said plural actuators for controlling discharge fluid pressure of the said variable displacement hydraulic pump unit.

BRIEF DESCRIPTION OF THE DRAWINGS

These and other features, advantages and objects of the present invention will become more readily apparent from a reading of the following detailed description made with reference to various Figures in the drawings attached hereto showing certain illustrative, presently preferred forms of embodiment of the present invention. In this connection, it should be noted that such embodiments as illustrated in the accompanying drawings hereof are intended in no way to limit the present invention but to facilitate an explanation and understanding thereof.

BEST MODES FOR CARRYING OUT THE INVENTION

Hereinafter, suitable embodiments of the present invention implemented with respect to a pressure fluid supply and delivery apparatus are set out with reference to the accompanying drawings hereof.

Figure 1:
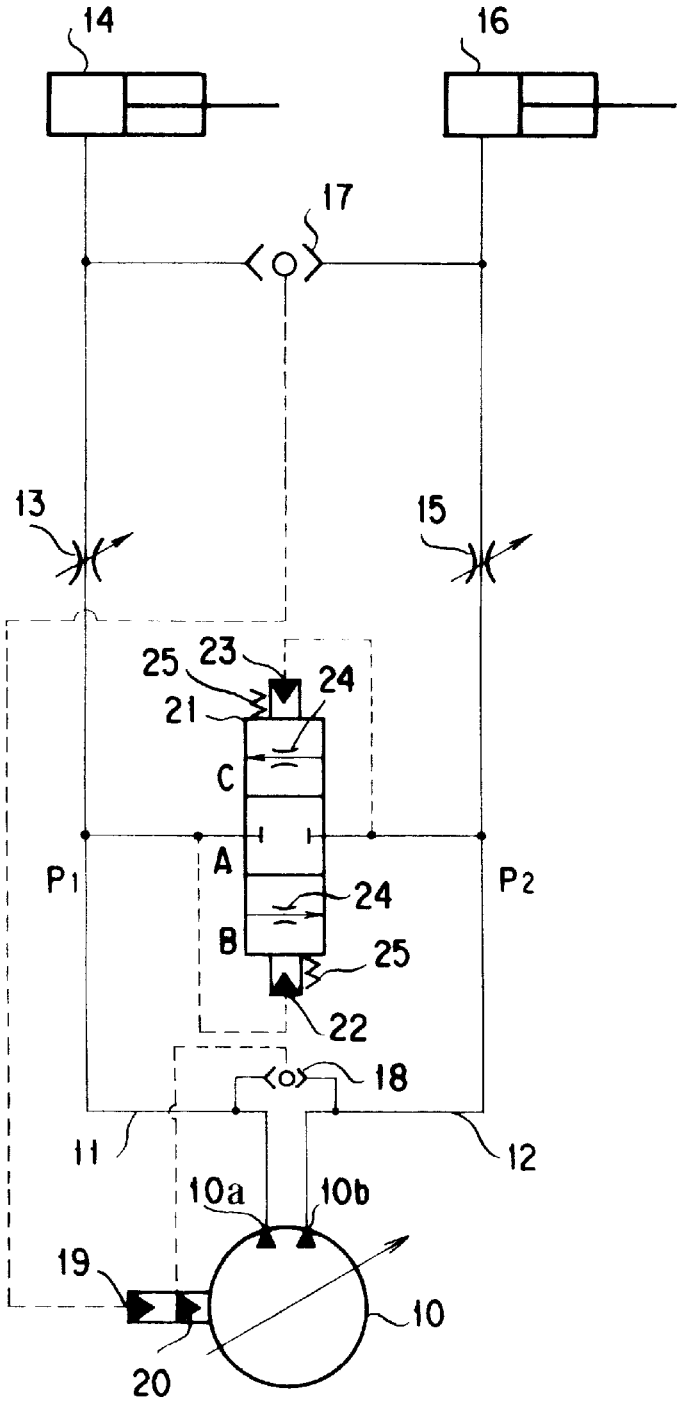
FIG. 1 is a hydraulic circuit diagram showing an improved pressure fluid supply and delivery apparatus representing a first form of embodiment of the present invention, using a double hydraulic pump (which composed of two hydraulic pumps made in a single block) as a variable displacement hydraulic pump.

In FIG. 1 there is shown a pressure fluid supply and delivery apparatus according to a first form of embodiment of the present invention.

The apparatus includes a double hydraulic pump 10 that is provided with a first and a second fluid discharge port 10*a* and 10*b* having a first and a second fluid output passage or circuit 11 and 12 connected thereto, respectively. The first fluid output circuit or passage 11 is connected via a first operating valve 13 to a first fluid operated actuator 14. Likewise, the second fluid output circuit or passage 12 is connected via a second operating valve 15 to a second fluid operated actuator 16.

A first shuttle valve 17 is provided to selectively sense or detect the one of the respective load pressures in the first and second actuators 14 and 16 that is higher than the other (a maximum load pressure).

A second shuttle valve 18 is provided to selectively sense or detect the one of the respective discharge pressures in the first and second fluid discharge ports 10*a* and 10*b* (a maximum discharge pressure).

The double hydraulic pump 10 has a first and a second displacement control section 19 and 20. A maximum load pressure sensed or detected by the first shuttle valve 17 is applicable to act on the first displacement control section 19. A maximum discharge pressure sensed or detected by the second shuttle valve 18 is applicable to act on the second displacement control section 20.

The first and second displacement control sections 19 and 20 are jointly operable to direct the double hydraulic pump 10 to operate so that when the maximum load pressure is higher than the maximum discharge pressure by more than a given value the discharge pressure of the double hydraulic pump 10 may be increased and when the maximum load pressure is lower than the maximum discharge pressure more than a given value the discharge pressure of the double hydraulic pump unit may be reduced.

Control is thus effected over the operation of the double hydraulic pump 10 so as to maintain the difference between its maximum delivery or discharge pressure and the maximum load pressure substantially constant.

It should be noted that the discharge pressure of the double hydraulic pump 10 may also be controlled by providing the pump 10 further with a third displacement control section (not shown) and permitting the pressures in the first and second fluid discharge ports 10*a* and 10*b* to act on the second displacement control section 20 and that third displacement control section added, respectively.

The apparatus also includes a combining valve 21 provided to establish and block fluid communication between the first and second fluid circuits 11 and 12. The combining valve 21 is adapted to import a pressure in the first fluid circuit 11 into its first pressure receiving portion 22 and to import a pressure in the second fluid circuit 12 into its second pressure receiving portion 23.

The combining valve 21 is so constructed that when the first and second circuits 11 and 12 have an equal pressure it may be held by the spring forces of springs 25 at its blocking position A at which it blocks fluid communication between the first and second fluid circuits 11 and 12. And, when the first and second circuits 11 and 12 have different pressures, the combining valve 21 may be switched under the higher of these pressures to take its first or second position of communication B or C. Taking either the position B or C, the combining valve 21 will establish a fluid communication between the first and second fluid circuits 11 and 12) with a fluid flowing from one of these circuits that is higher in pressure into the other via a constriction 24 provided in the combining valve 21.

Figure 2:
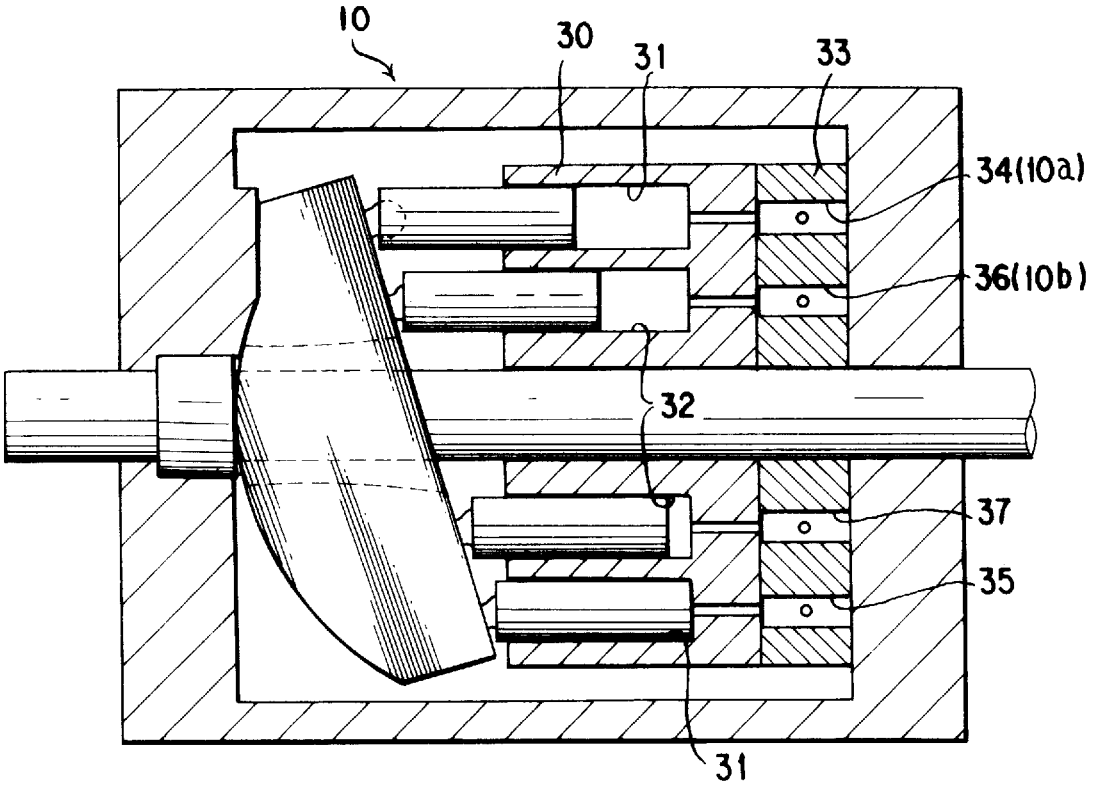
FIG. 2 is a cross sectional view illustrating a certain, presently preferred construction of the double hydraulic pump for use in the pressure fluid supply and delivery apparatus shown in FIG. 1.

Referring now to FIG. 2, the double hydraulic pump 10 is shown as having a cylinder block 30 and a plurality of cylinder bores in a first group 31 and a plurality of cylinder bores in a second group 32 which are formed in two concentric circular arrangements in the cylinder block 30, positioned closer to its outer and inner peripheries, respectively. Further, the pump unit 10 has a valve plate 33 and a first set of a high pressure and a low pressure port 34 and 35 and a second set of a high pressure and a low pressure plate 36 and 37 which are formed in two concentric circular arrangements in the valve plate 33, positioned closer to its outer and inner peripheries, respectively.

So constructed as described above, it is seen that the double hydraulic pump 10 is made up of a first and a second hydraulic pump in a single block, which are independent of each other and have a common driving shaft, thus providing a variable delivery or displacement hydraulic pump unit or assembly with a plurality of discharge or discharge ports. Here, it is seen that the discharge outlet (constituted by the first high pressure port 34) of that first hydraulic pump provides for the first discharge port 10*a* and the discharge outlet (constituted by the second high pressure port 36) of that second hydraulic pump provides for the second discharge port 10*b*.

Figure 3:
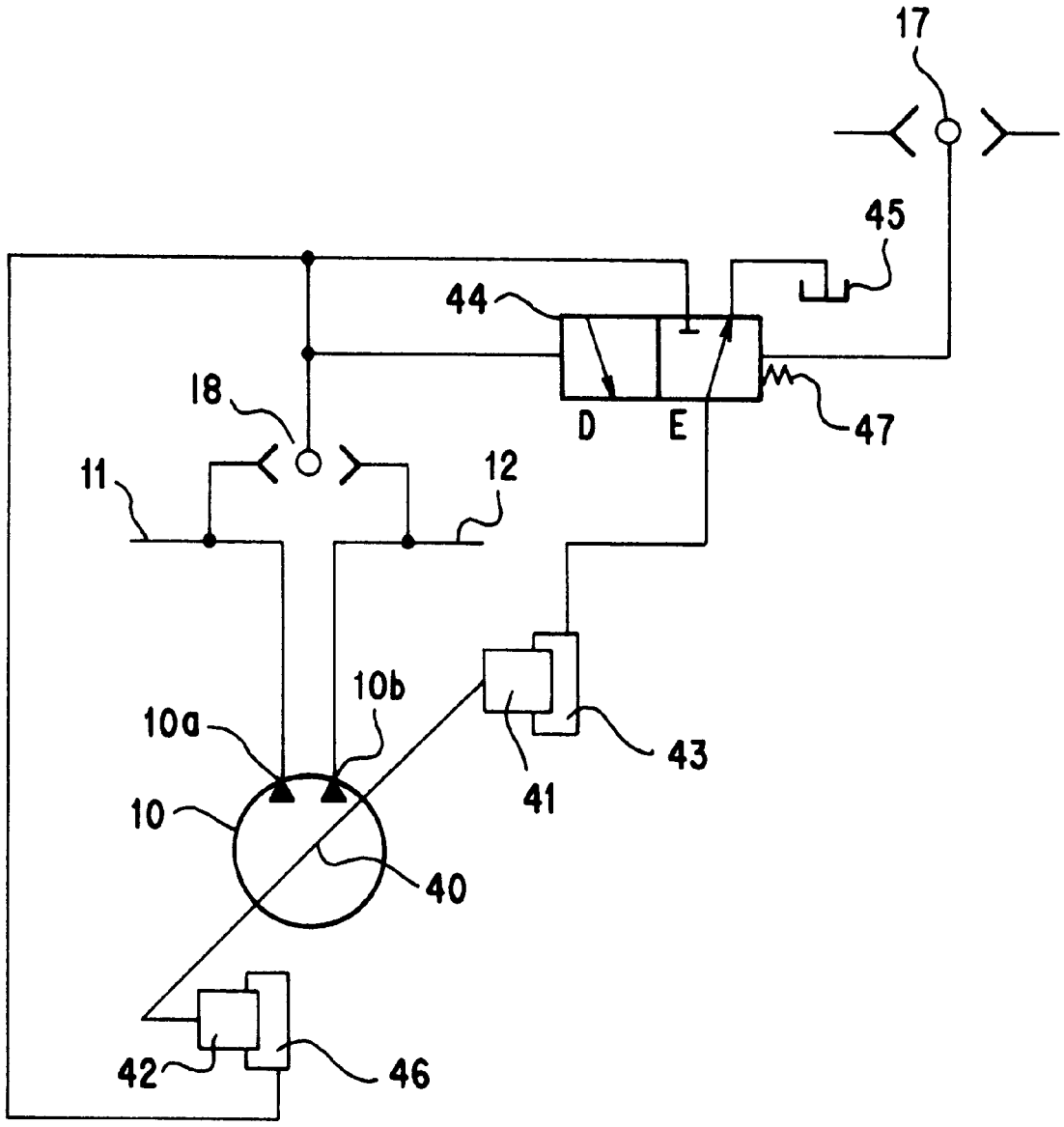
FIG. 3 is a hydraulic circuit diagram showing a displacement control means for use with the double hydraulic pump shown in FIGS. 1 and 2.

Referring next to FIG. 3, a construction of the fluid delivery or displacement control sections 19 and 20 is shown and will be described.

For controlling the fluid delivery, thus fluid displacement of the double hydraulic pump 10 described above, a fluid displacement control member 40 is movable by a first control piston 41 of a large diameter so as to reduce the pump displacement, and by a second control piston 42 of a small diameter so as to increase the pump displacement. The first control piston 41 has a pressure receiving chamber 43 associated therewith that is arranged to communicate via a displacement control valve 44 with the output side of the second shuttle valve 18 and a fluid reservoir 45, the valve 44 controlling fluid communication of the pressure receiving chamber 43 selectively with one of the shuttle valve 18 output side and the reservoir 45.

The second control piston 42 has a pressure receiving chamber 46 associated therewith that lies in fluid communication with the output side of the second shuttle valve 18.

The displacement control valve 44 has a first and a second position D and E that it takes with its spool or movable part pushed therein by an output pressure of the second shuttle valve 18 (maximum discharge pressure) and by an output pressure of the first shuttle valve 17 (maximum load pressure) and by a spring 47, respectively.

If the displacement control valve 44 lies at its first position D, the pressure receiving chamber 43 is placed in fluid communication with the output side of the second shuttle valve 18. If it takes the second position E, the pressure receiving chamber 43 communicates with the reservoir 45.

When the maximum discharge pressure is higher than the maximum load pressure by an amount that is more than that commensurate with the spring force of the spring 47, the displacement control valve 44 takes its first position D, thereby permitting the maximum discharge pressure to be applied to the pressure receiving chamber 43. Then, the displacement control member 40 is moved by a difference in pressure receiving area between the first and second control pistons 41 and 42 to reduce the pump fluid displacement or delivery, thus reducing the discharge (delivery) pressure of the hydraulic pump 10.

When the maximum load pressure is higher than the pressure which equals the maximum discharge pressure subtracted by the pressure commensurate with the spring force of the spring 47, the displacement control valve 44 takes its second position E and the pressure receiving chamber 43 communicates with the reservoir 45. This makes the second control piston 42 move the displacement control member 40 in a direction such as to increase the pump displacement. The discharge pressure of the hydraulic pump 10 is thus increased.

In this manner, the fluid delivery or displacement, thus the discharge pressure of the double hydraulic pump 10 is controlled so as to maintain the difference between the maximum discharge pressure and the maximum load pressure constant or substantially constant at a pressure level that is commensurate with the spring force of the spring 47.

Now turning to the operation of the pressure fluid supply and delivery apparatus of the invention embodied in the first form described above, two situations are assumed with respect to the loads that may develop for the actuators and the volumetric flows in which pressure fluid is required to be fed into them, respectively.

In a first situation, in the arrangement of FIG. 1 it is assumed that the first actuator 14 has a lower load (load pressure) and a larger required volumetric flow, and the second actuator 16 has a higher load (load pressure) and a smaller required volumetric flow.

A required volumetric flow is determined by an opening (amount of operation) of an operating valve. Hence, a larger required volumetric flow means an enlarged opening thereof and a smaller required volumetric flows means a reduced opening thereof.

If the first and second operating valves 13 and 15 are each in its neutral state (with its opening zero), the actuator load pressures and the pump discharge pressure will be all zero or substantially zero. From this state, the first and second operating valves 13 and 15 commences to be operated simultaneously. The first operating valve 13 has a larger opening and the second operating valve 15 has a smaller opening. The shuttle valve 16 senses a higher, thus highest of the load pressures that develop in the first and second actuators 14 and 16. In the situation assumed, the load pressure for the second actuator 16 is sensed as the highest load pressure. The highest load pressure sensed is applied to act on the first displacement control section 19 for the double hydraulic pump 10. The second shuttle valve 18 senses a higher, thus highest of the discharge pressures in the first and second discharge ports 10*a* and 10*b* of the double hydraulic pump 10. The highest discharge pressure sensed is applied to act on the second displacement control section 20 for the double hydraulic pump 10.

The highest load pressure and the highest discharge pressure acting on the first and second displacement control sections 19 and 20, the highest discharge pressure will still be low. Here, the discharge pressure of the double hydraulic pump 10 is controlled so as to maintain constant or substantially constant the difference between the highest load pressure and the highest discharge pressure, namely pressure difference determined by the first and second fluid displacement control sections, and thus is increased until it becomes a pressure that is higher than the maximum load pressure by a fixed pressure.

The pressure in the first fluid circuit 11 rises up until it reaches a pressure level that corresponds to the load pressure in the first actuator 14. The pressure in the second fluid circuit 12 rises until it reaches a pressure level that corresponds to the load pressure in the second actuator 16.

A difference in load pressure between the first and second actuators 14 and 16 produces a difference in pressure between the first and second fluid circuits 11 and 12.

The pressure P2 in the second fluid circuit 12 being here higher than the pressure P1 in the first fluid circuit 11 causes the combining valve 21 to take its second position of communication C. With the combining valve 21 taking this position of communication C, it follows that the first and second fluid circuits 11 and 12 are caused to communicate with each other via the constriction 24 provided internally for the combining valve 21. Thus, in the state that the first and second operating valves 13 and 15 are simultaneously operated, i.e., there are flows from the first and second circuits 11 and 12 to the operating valves 13 and 15, respectively, a portion of the volumetric flow being supplied through the second circuit 12 and delivered into the second actuator 16 that is higher in load pressure is shunted into the first circuit 11 for the first actuator 14 that is lower in load pressure to supplement the volumetric flow flowing therethrough. This being via the constriction 24, difference in pressure is maintained between the second and first fluid circuits 12 and 11, and fluid shunting and supplementation is continued.

Requirement for a volumetric flow is thereby met for each of the operating valves 13 and 15.

Stated more concisely, it may be noted that a pressure fluid is discharged from the double hydraulic pump 10 through its first and second discharge ports 10*a* and 10*b* in an identical volumetric flow. The pressure P2 in the second fluid circuit 12 is higher than the pressure P1 in the first fluid circuit 11. The first operating valve 13 is larger in opening than the second operating valve 15. Then, the combining valve 21 is caused to take its second position of fluid communication C to effect fluid shunting and supplementation from the second circuit 12 via the constriction 24 into the first circuit 11. It follows, therefore, that the first operating valve 13 that is larger in opening is supplied with pressure fluid in a volumetric flow that is larger than in the first discharge port 10*a* while the second operating valve 15 that is smaller in opening is supplied with pressure fluid in a volumetric flow that is smaller than in the second discharge port 10*b*. As a consequence, it is seen that the first and second operating valves 13 and 15 will have pressure fluid flowing into them in volumetric flows that are commensurate with or correspond to their respective openings.

It is also seen that pressure will build up in the first fluid circuit 11, rising to a level commensurate with or corresponding to a load pressure that develops in the first actuator 14. In the second fluid circuit 12 pressure will build up, rising to a level commensurate with or corresponding to a load pressure developing in the second actuator 16.

This in turn causes these fluid pressures to pass along into the first and second operating valves 13 and 15, that are commensurate with or correspond to the load pressures in the first and second actuators, respectively.

Pressures commensurate with or corresponding to load pressures in the first and second actuators 14 and 16, respectively, are thus passed along into the first and second operating valves 13 and 15. Only a loss in pressure caused is therefore one for fluid passing through the constriction 24 provided in the combining valve 21 and is evidently much less than as encountered in the prior art.

Consequently, with input pressures compensated for, the first and second actuators 14 and 16 are allowed to operate simultaneously. And, with a fluid discharge pressure of the double hydraulic pump and a difference between maximum load and maximum discharge pressure held constant, the requirement for a volumetric flow for each of the operating valves 13 and 15 can be satisfied. The result is a further reduction in loss in pressure.

In a second situation assumed, the first actuator 14 has a lower load pressure and a smaller required volumetric flow, and the second actuator 16 has a higher load pressure and a smaller required volumetric flow.

As in the preceding case, maneuvering the operating valves 13 and 15 at the same time causes the combining valve 21 to assume its second position of fluid communication C. In this case, however, the requirement for a smaller volumetric flow for the operating valve 13 reduces the shunted and supplemented volumetric flow through the combining valve 21 as described below.

A smaller required volumetric flow in the present case indicates that the opening in the first operating valve 13 is smaller. Here, shunting a portion of the volumetric flow in the second fluid circuit 12 to supplement therewith the volumetric flow in the first fluid circuit 11 leaves the opening in the first operating valve 13 smaller. Pressure P1 in the first fluid circuit 11 soon rises and becomes equal to pressure P2 in the second circuit 12, causing the combining valve 19 to return to its blocking position A.

The second actuator 16 requiring a larger volumetric flow is thereby supplied with such a volumetric flow as needed.

The combining valve 21 returning to the blocking position A reduces the pressure in the first fluid circuit 11. Since this reduces the pressure in the first fluid circuit 11, the combining valve 21 comes to resume its second position C of fluid communication. These actions are repeated for the combining valve 21.

Figure 4:
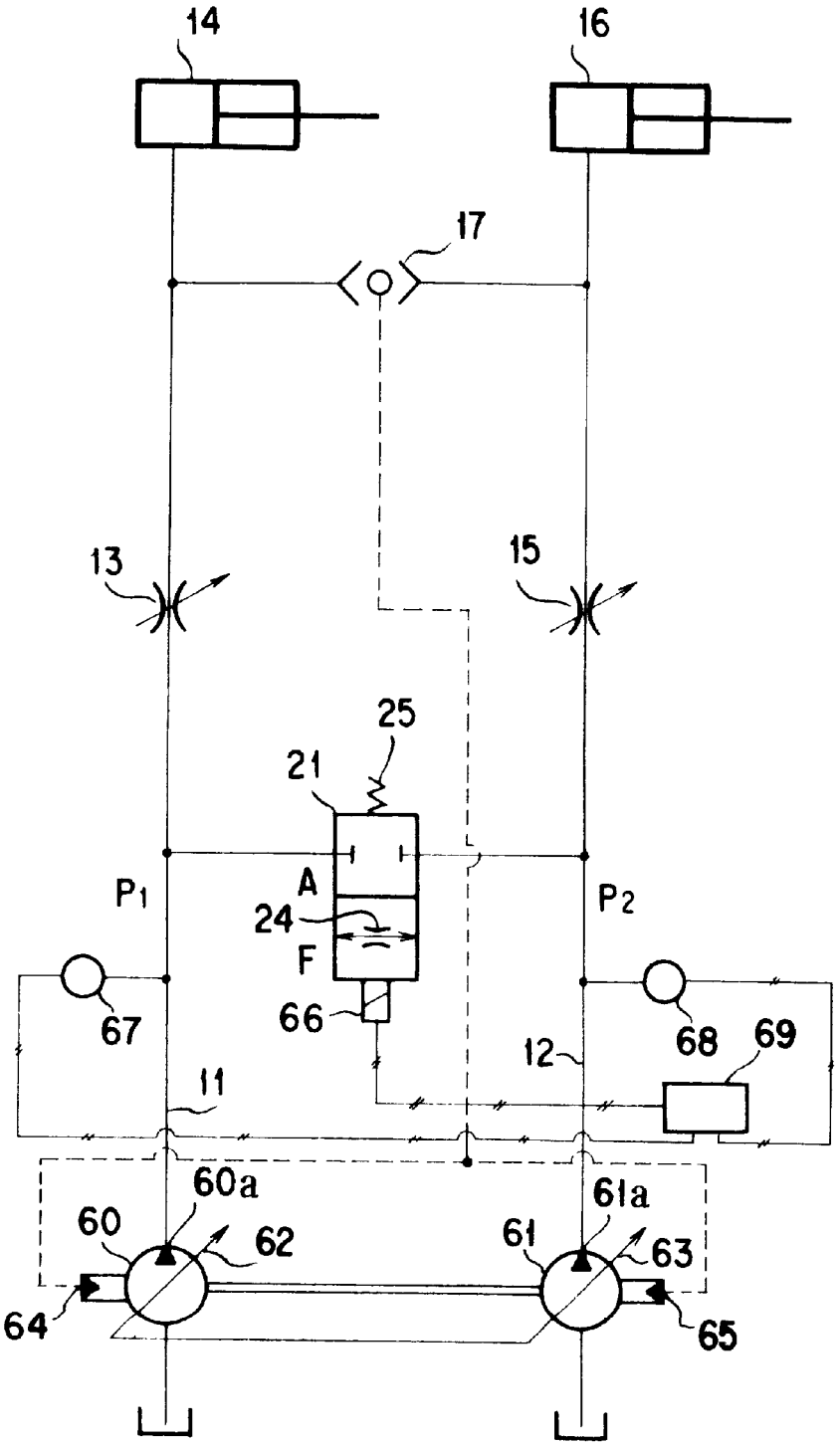
FIG. 4 is a hydraulic circuit diagram showing an improved pressure fluid supply and delivery apparatus representing a second form of embodiment of the present invention.

Referring next to FIG. 4, an explanation will be given of a pressure fluid supply and delivery apparatus according to a second form of embodiment of the present invention.

The apparatus shown includes a first and a second hydraulic pump 60 and 61 whose drive shafts are mechanically coupled with each other and thus can be assumed to be common. The first and second hydraulic pumps 60 and 61 have their respective fluid delivery control members 62 and 63 coupled together so as to have an identical displacement, providing a variable desplacement pump unit having a plurality of fluid discharge ports, 60*a* and 61*a*, and a common drive shaft. Here, a first shuttle valve 17 is again provided and has its output pressure for supply into a displacement control section 64 of the first hydraulic pump 60 and a displacement control section 65 of the second hydraulic pump 61.

In this form of embodiment, a first fluid circuit 11 is connected to the fluid discharge port 60*a* of the first hydraulic pump 60 and a second fluid circuit 12 is connected to the fluid discharge port 61*a* of the second hydraulic pump 61. A combining valve 21 is used again to establish and block fluid communication between the first and second fluid circuits 11 and 12. In this embodiment, the combining valve 21 has its blocking position A that it takes by being acted on by the spring force of a spring 25, and its position of fluid communication that it takes when a solenoid 66 mechanically coupled thereto is electrically energized. A first and a second pressure sensor 67 and 68 are provided to sense pressures in the first and second fluid circuits 11 and 12, respectively, the sensed pressure signals being furnished into a controller 69. The controller 69 is adapted to provide an output signal that electrically energizes the solenoid when there develops a difference between the fluid pressure sensed by the first pressure sensor 67 and the fluid pressure sensed by the second sensor 68.

Figure 5:
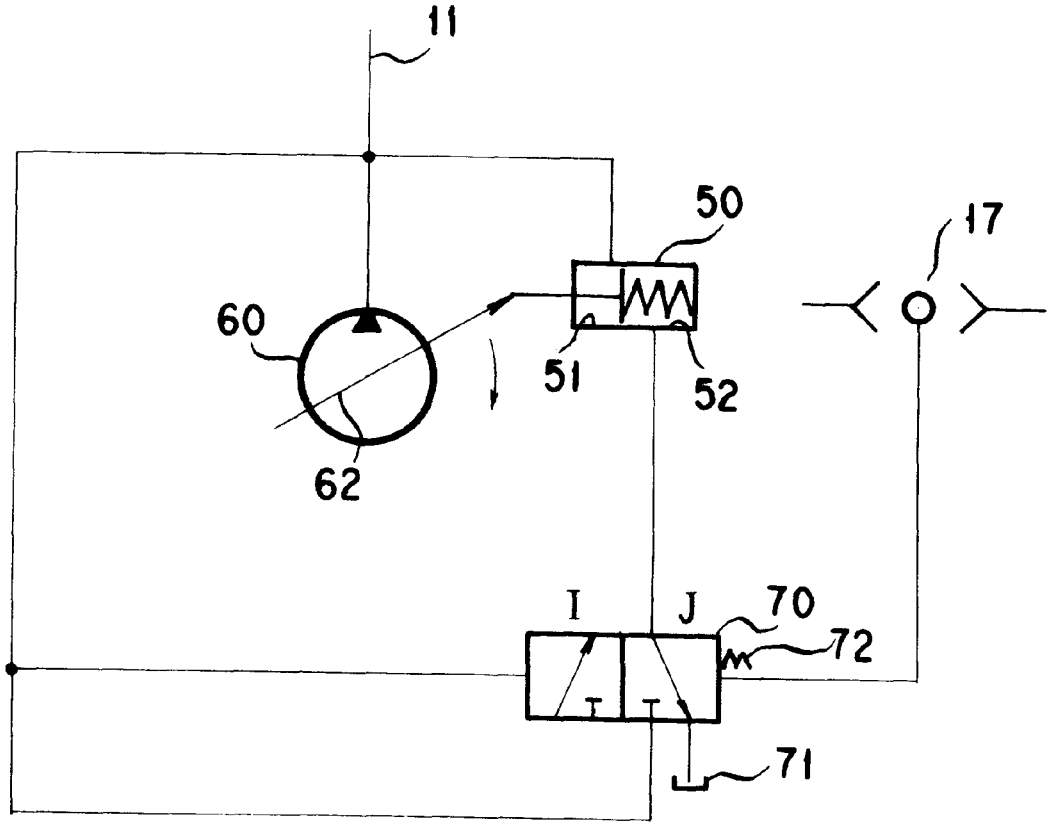
FIG. 5 is a hydraulic circuit diagram showing a certain, presently preferred construction of the displacement control means for the use with the hydraulic pump shown in FIG. 4.

A certain, preferred example of the displacement control section 64 of the first hydraulic pump 60 is shown in FIG. 5. The control section 64 includes a displacement control cylinder 50 for controllably moving the displacement control member 62.

The displacement control cylinder 50 has a first and a second chamber 51 and 52 and is operable in a such a manner that furnishing the first chamber 51 in the displacement control cylinder 50 with a fluid pressure and bringing the second chamber 52 into fluid communication with a reservoir 56 moves the displacement control member 62 in a direction such as to increase displacement of the pump and furnishing each of both the first and second chambers 51 and 52 in the displacement control cylinder 50 with a fluid pressure moves the displacement control member 62 moves in a direction such as to reduce displacement of the pump.

A displacement control valve 70 is provided having its fluid supply position I that it takes when pressure P1 in the first fluid circuit 11 is higher than a maximum load pressure sensed by and furnished from the first shuttle valve 17 by an amount that is commensurate with the spring force of a spring 72, and its drain position J that it otherwise takes.

With the displacement control section 64 so arranged and constructed as described above, it will be seen that the movement of the displacement control member 62 is controlled so as to maintain constant or substantially constant the difference between the pressure P1 in the first fluid circuit 11 and the maximum load pressure sensed by the first shuttle valve 17.

The displacement control section 65 for the second hydraulic valve 61 is of the same construction and arrangement as the displacement a control section 64 shown in FIG. 5 and above described.

It should be noted that the displacement control members 62 and 63 for the first and second hydraulic pumps 60 and 61 are provided so as to move jointly.

This arrangement permits the fluid displacement or delivery, thus the discharge pressure of the first and second hydraulic pumps 60 and 61 to be controlled so as to maintain the difference between the higher discharge pressure (maximum discharge pressure) and the maximum load pressure constant or substantially constant. The both pumps are identical in fluid delivery or displacement.

While the preceding two forms of embodiment of the present invention has a single fluid operated actuator connected via a single operating valve to each of the first and second fluid circuits 11 and 12, it should be noted that a plurality of actuators may be used that are connected in parallel to each of the first and second fluid circuits 11 and 12 via a plurality of operating valves, respectively.

Figure 6:
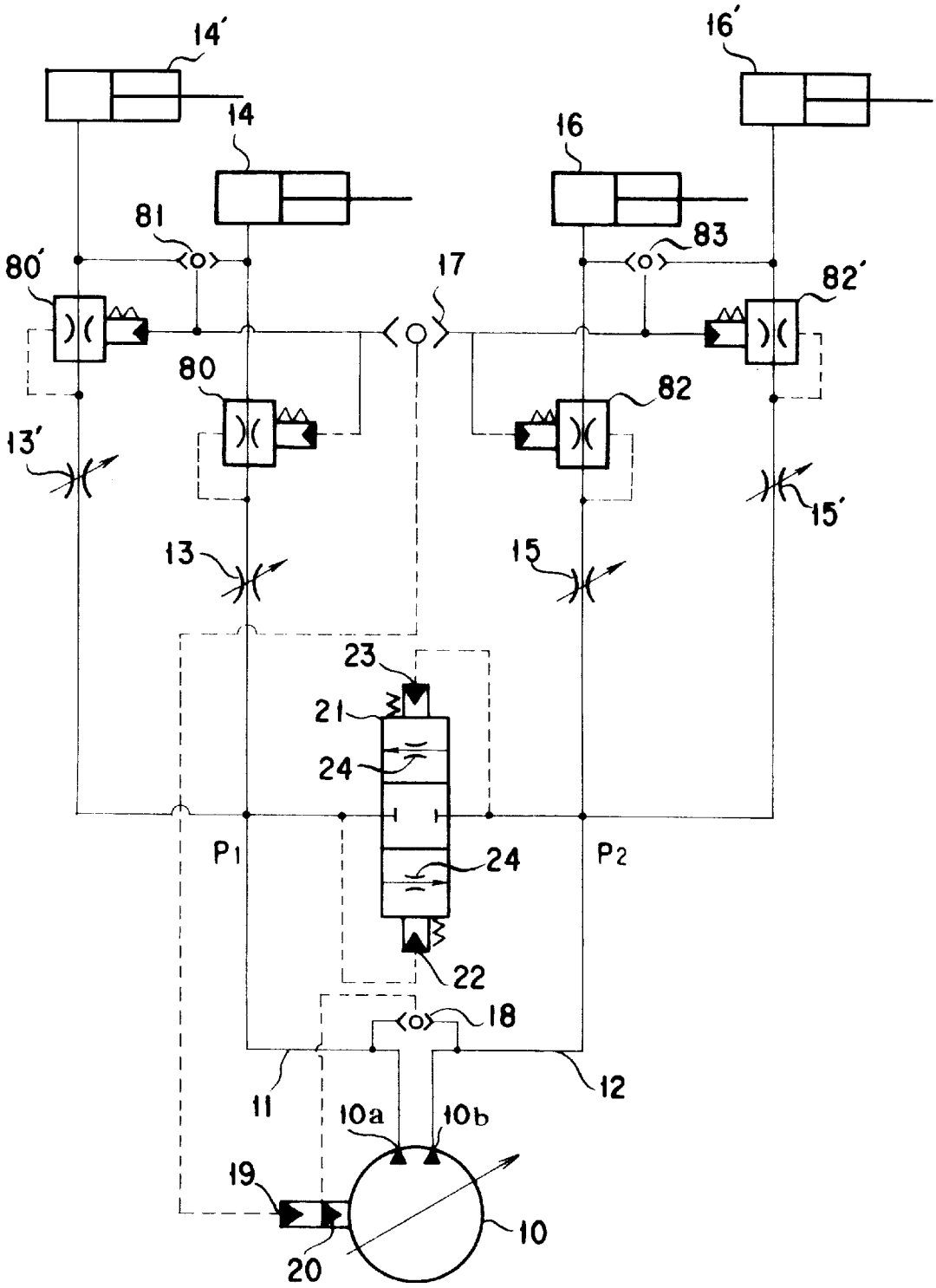
FIG. 6 is a hydraulic circuit diagram showing a hydraulic circuit diagram showing an improved pressure fluid supply and delivery apparatus according to the present invention in which a plurality of fluid operable actuators are connected in parallel to each of a first and a second circuit.

For example, as shown in FIG. 6, a plurality of first actuators 14, 14' are connected in parallel to the first fluid circuit 11 via a plurality of first operating valves 13, 13', respectively. A plurality of first pressure compensation valves 80, 80' are also provided between a first actuator 14, 14' and a first operating valve 13, 13', respectively. A shuttle valve 81 is provided to sense a higher of the load pressures of the plural first actuators 14, 14'. The sensed load pressure is applied to act on the plural first pressure compensation valves 80, 80', thereby determining a set pressure for these first pressure compensation valves 80, 80'.

Likewise, a plurality of second actuators 16, 16' are connected in parallel to the second fluid circuit 12 via a plurality of second operating valves 15, 15', respectively. A plurality of second pressure compensation valves 82, 82' are also provided between a second actuator 16, 16' and a second operating valve 15, 15', respectively.

A shuttle valve 83 is provided to sense a higher of the load pressures of the plural second actuators 16, 16'. The sensed load pressure is applied to act on the plural second pressure compensation valves 82, 82', thereby determining a set pressure for these second pressure compensation valves 82, 82'.

The higher load pressure in the plural first actuators 14, 14' connected to the first circuit 11, which is sensed by the shuttle valve 81, and the higher load pressure in the plural second actuators 16, 16', which is sensed by the shuttle valve 83, are compared by a first shuttle valve 17 as previously indicated. Thereon, a higher of these load pressures is imported into a first displacement control section 19 as previously mentioned, thereby controlling the discharge or delivery pressure of the double hydraulic pump 10 shown in FIGS. 1 to 3 in a manner as previously described in connection therewith.

Figure 7:
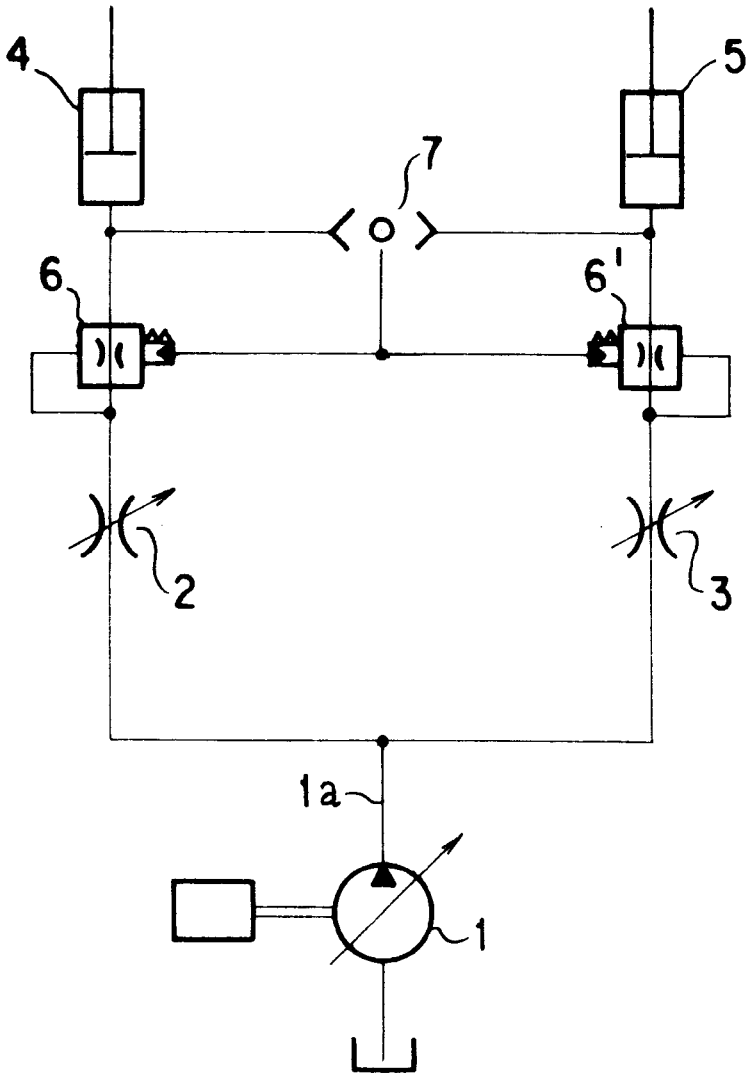
FIG. 7 is a hydraulic circuit diagram showing a pressure fluid supply and delivery apparatus according to the prior art.

This permits the plural actuators 14, 14' connected in parallel to the first fluid circuit 11 to be fed with a pressure in the first fluid circuit 11 compensated as in the prior art shown in and described in connection with FIG. 7. Likewise, the plural actuators 16, 16' connected in parallel to the second fluid circuit 12 can be fed with a pressure in the second fluid circuit 12 compensated as in the prior art shown in and described in connection with FIG. 7.

While the present invention has herein before been set forth with respect to certain illustrative, presently preferred embodiments thereof, it will readily be appreciated by a person skilled in the art to be obvious that many alterations thereof, omissions therefrom and additions thereto can be made without departing from the essence and the scope of the present invention. Accordingly, it should be understood that the invention is not intended to be limited to the specific embodiments thereof set out above, but to include all possible embodiments thereof that can be made within the scope with respect to the features specifically set forth in the appended claims and encompasses all the equivalents thereof.

What is claimed is:

1. A pressure fluid supply and delivery apparatus comprising:

a variable displacement hydraulic pump unit having a plurality of fluid discharge ports independent each other and a common drive shaft;

a plurality of fluid circuits connected to said plural discharge ports, respectively;

a plurality of fluid operated actuators connected via respective operating valves to said plural fluid circuits, respectively;

a displacement control means operable in response to discharge pressures in said plural fluid discharge ports and load pressures in said plural actuators for controlling discharge fluid pressure of said variable displacement hydraulic pump unit; and a combining valve means disposed between said plural fluid circuits, and operable to block fluid communication between said plural fluid circuits when said plural fluid discharge ports have an equal pressure and operable to establish fluid communication between said fluid circuits via a constriction when a difference in pressure develops between said fluid discharge ports.

2. A pressure fluid supply and delivery apparatus as set forth in claim 1 in which said variable displacement hydraulic pump unit has a plurality of groups of cylinder bores with the groups consisting of a plurality of cylinder bores formed in a plurality of concentric circular arrangements in a cylinder block of a swash plate hydraulic pump, positioned closer to its outer and inner peripheries, respectively, and a plurality of sets of pressure ports with the sets consisting of a plurality of high pressure ports and a plurality of low pressure ports formed in a plurality of concentric circular arrangements in a valve plate, positioned closer to its outer and inner peripheries, respectively.

3. A pressure fluid supply and delivery apparatus as set forth in claim 2 in which said combining valve includes a spring, a first pressure receiving portion connected to one of said plural fluid circuits, and a second pressure receiving portion connected to another of said plural fluid circuits, said combining valve being operable to take its fluid blocking position with a spring force of said spring acting thereon, its first position of fluid communication with a pressure applied to said first pressure receiving portion and its second position of fluid communication with a pressure applied to said second pressure receiving portion.

4. A pressure fluid supply and delivery apparatus as set forth in claim 3 in which said displacement control means is operable in response to a highest of the discharge pressures in said plural fluid discharge ports and a highest of the load pressures in said plural actuators for controlling discharge fluid pressure of said variable displacement hydraulic pump unit.

5. A pressure fluid supply and delivery apparatus as set forth in claim 2 in which said displacement control means is operable in response to a highest of the discharge pressures in said plural fluid discharge ports and a highest of the load pressures in said plural actuators for controlling discharge fluid pressure of said variable displacement hydraulic pump unit.

6. A pressure fluid supply and delivery apparatus comprising:

a variable displacement hydraulic pump unit having a plurality of fluid discharge ports independent of each other and a common drive shaft;

a plurality of fluid circuits connected to said plural discharge ports respectively;

a plurality of fluid operated actuators connected via respective operating valves to said plural fluid circuits, respectively;

a displacement control means operable in response to discharge pressures in said plural fluid discharge ports and load pressures in said plural actuators for controlling discharge fluid pressure of said variable displacement hydraulic pump unit; and a combining valve means disposed between said plural fluid circuits, and operable to block fluid communication between said plural fluid circuits when said plural fluid discharge ports have an equal pressure and operable to establish fluid communication between said fluid circuits via a constriction when a difference in pressure develops between said fluid discharge ports, wherein said combining valve includes a spring and a solenoid and is operable to take its fluid blocking position with a spring force of said spring and its position of fluid communication with an external signal furnished to said solenoid, said apparatus further comprising:

a first and a second sensor for sensing a pressure in one of said plural fluid circuits and a pressure in another of said plural fluid circuits, respectively; and a controller operable in response to development of a difference between the pressures sensed by said first and second sensors for furnishing said solenoid with said external signal.

7. A pressure fluid supply and delivery apparatus comprising:

a variable displacement hydraulic pump unit having a plurality of fluid discharge ports independent of each other and a common drive shaft;

a plurality of fluid circuits connected to said plural discharge ports respectively;

a plurality of fluid operated actuators connected via respective operating valves to said plural fluid circuits, respectively;

a displacement control means operable in response to discharge pressures in said plural fluid discharge ports and load pressures in said plural actuators for controlling discharge fluid pressure of said variable displacement hydraulic pump unit; and a combining valve means disposed between said plural fluid circuits, and operable to block fluid communication between said plural fluid circuits when said plural fluid discharge ports have an equal pressure and operable to establish fluid communication between said fluid circuits via a constriction when a difference in pressure develops between said fluid discharge ports, wherein said variable displacement hydraulic pump unit has a plurality of groups of cylinder bores with the groups consisting of a plurality of cylinder bores formed in a plurality of concentric circular arrangements in a cylinder block of a swash plate hydraulic pump, positioned closer to its outer and inner peripheries, respectively and a plurality of sets of pressure ports with the sets consisting of a plurality of high pressure ports and a plurality of low pressure ports formed in a plurality of concentric circular arrangements in a valve plate, positioned closer to its outer and inner peripheries respectively, wherein said combining valve includes a spring and a solenoid and is operable to take its fluid blocking position with a spring force of said spring and its position of fluid communication with an external signal furnished to said solenoid, said apparatus further comprising:

a first and a second sensor for sensing a pressure in one of said plural fluid circuits and a pressure in another of said plural fluid circuits, respectively; and a controller operable in response to development of a difference between the pressures sensed by said first and second sensors for furnishing said solenoid with said external signal.

8. A pressure fluid supply and delivery apparatus comprising:

a variable displacement hydraulic pump unit having a plurality of fluid discharge ports independent of each other and a common drive shaft;

a plurality of fluid circuits connected to said plural discharge ports, respectively;

a plurality of fluid operated actuators connected via respective operating valves to said plural fluid circuits, respectively;

a displacement control means operable in response to discharge pressures in said plural fluid discharge ports and load pressures in said plural actuators for controlling discharge fluid pressure of said variable displacement hydraulic pump unit; and a combining valve means disposed between said plural fluid circuits, and operable to block fluid communication between said plural fluid circuits when said plural fluid discharge ports have an equal pressure and operable to establish fluid communication between said fluid circuits via a constriction when a difference in pressure develops between said fluid discharge ports, wherein said variable displacement hydraulic pump unit comprises a plurality of hydraulic pumps of variable displacement type, having their respective drive shafts mechanically coupled together and their respective displacement control members connected to each other so that the plural hydraulic pumps have an identical displacement, wherein said combining valve includes a spring and a solenoid and is operable to take its fluid blocking position with a spring force of said spring and its position of fluid communication with an external signal furnished to said solenoid, said apparatus further comprising:

a first and a second sensor for sensing a pressure in one of said plural fluid circuits and a pressure in another of said plural fluid circuits, respectively; and a controller operable in response to development of a difference between the pressures sensed by said first and second sensors for furnishing said solenoid with said external signal.

9. A pressure fluid supply and delivery apparatus comprising:

a variable displacement hydraulic pump unit having a plurality of fluid discharge ports independent of each other and a common drive shaft;

a plurality of fluid circuits connected to said plural discharge ports, respectively;

a plurality of fluid operated actuators connected via respective operating valves to said plural fluid circuits, respectively;

a displacement control means operable in response to discharge pressures in said plural fluid discharge ports and load pressures in said plural actuators for controlling discharge fluid pressure of said variable displacement hydraulic pump unit; and a combining valve means disposed between said plural fluid circuits, and operable to block fluid communication between said plural fluid circuits when said plural fluid discharge ports have an equal pressure and operable to establish fluid communication between said fluid circuits via a constriction when a difference in pressure develops between said fluid discharge ports, wherein said variable displacement hydraulic pump unit comprises a plurality of hydraulic pumps of variable displacement type, having their respective drive shafts mechanically coupled together and their respective displacement control members connected to each other so that the plural hydraulic pumps have an identical displacement, wherein said displacement control means is operable in response to a highest of the discharge pressures in said plural fluid discharge ports and a highest of the load pressures in said plural actuators for controlling discharge fluid pressure of said variable displacement hydraulic pump unit.

10. A pressure fluid supply and delivery apparatus comprising:

a variable displacement hydraulic pump unit having a plurality of fluid discharge ports independent of each other and a common drive shaft;

a plurality of fluid circuits connected to said plural discharge ports, respectively;

a plurality of fluid operated actuators connected via respective operating valves to said plural fluid circuits, respectively;

a displacement control means operable in response to discharge pressures in said plural fluid discharge ports and load pressures in said plural actuators for controlling discharge fluid pressure of said variable displacement hydraulic pump unit; and a combining valve means disposed between said plural fluid circuits, and operable to block fluid communication between said plural fluid circuits when said plural fluid discharge ports have an equal pressure and operable to establish fluid communication between said fluid circuits via a constriction when a difference in pressure develops between said fluid discharge ports, wherein said combining valve includes a spring and a solenoid and is operable to take its fluid blocking position with a spring force of said spring and its position of fluid communication with an external signal furnished to said solenoid, said apparatus further comprising:

a first and a second sensor for sensing a pressure in one of said plural fluid circuits and a pressure in another of said plural fluid circuits, respectively; and a controller operable in response to development of a difference between the pressures sensed by said first and second sensors for furnishing said solenoid with said external signal, wherein said displacement control means is operable in response to a highest of the discharge pressures in said plural fluid discharge ports and a highest of the load pressures in said plural actuators for controlling discharge fluid pressure of said variable displacement hydraulic pump unit.

11. A pressure fluid supply and delivery apparatus comprising:

a variable displacement hydraulic pump unit having a plurality of fluid discharge ports independent of each other and a common drive shaft;

a plurality of fluid circuits connected to said plural discharge ports, respectively;

a plurality of fluid operated actuators connected via respective operating valves to said plural fluid circuits, respectively;

a displacement control means operable in response to discharge pressures in said plural fluid discharge ports and load pressures in said plural actuators for controlling discharge fluid pressure of said variable displacement hydraulic pump unit; and a combining valve means disposed between said plural fluid circuits, and operable to block fluid communication between said plural fluid circuits when said plural fluid discharge ports have an equal pressure and operable to establish fluid communication between said fluid circuits via a constriction when a difference in pressure develops between said fluid discharge ports, wherein said variable displacement hydraulic pump unit has a plurality of groups of cylinder bores with the groups consisting of a plurality of cylinder bores formed in a plurality of concentric circular arrangements in a cylinder block of a swash plate hydraulic pump, positioned closer to its outer and inner peripheries, respectively, and a plurality of sets of pressure ports with the sets consisting of a plurality of high pressure ports and a plurality of low pressure ports formed in a plurality of concentric circular arrangements in a valve plate, positioned closer to its outer and inner peripheries, respectively, wherein said combining valve includes a spring and a solenoid and is operable to take its fluid blocking position with a spring force of said spring and its position of fluid communication with an external signal furnished to said solenoid, said apparatus further comprising:

a first and a second sensor for sensing a pressure in one of said plural fluid circuits and a pressure in another of said plural fluid circuits, respectively; and a controller operable in response to development of a difference between the pressures sensed by said first and second sensors for furnishing said solenoid with said external signal, wherein said displacement control means is operable in response to a highest of the discharge pressures in said plural fluid discharge ports and a highest of the load pressures in said plural actuators for controlling discharge fluid pressure of said variable displacement hydraulic pump unit.

12. A pressure fluid supply and delivery apparatus comprising:

a variable displacement hydraulic pump unit having a plurality of fluid discharge ports independent of each other and a common drive shaft;

a plurality of fluid circuits connected to said plural discharge ports, respectively;

a plurality of fluid operated actuators connected via respective operating valves to said plural fluid circuits, respectively;

a displacement control means operable in response to discharge pressures in said plural fluid discharge ports and load pressures in said plural actuators for controlling discharge fluid pressure of said variable displacement hydraulic pump unit; and a combining valve means disposed between said plural fluid circuits, and operable to block fluid communication between said plural fluid circuits when said plural fluid discharge ports have an equal pressure and operable to establish fluid communication between said fluid circuits via a constriction when a difference in pressure develops between said fluid discharge ports, wherein said variable displacement hydraulic pump unit comprises a plurality of hydraulic pumps of variable displacement type, having their respective drive shafts mechanically coupled together and their respective displacement control members connected to each other so that the plural hydraulic pumps have an identical displacement, wherein said combining valve includes a spring and a solenoid and is operable to take its fluid blocking position with a spring force of said spring and its position of fluid communication with an external signal furnished to said solenoid, said apparatus further comprising:

a first and a second sensor for sensing a pressure in one of said plural fluid circuits and a pressure in another of said plural fluid circuits respectively; and a controller operable in response to development of a difference between the pressures sensed by said first and second sensors for furnishing said solenoid with said external signal, wherein said displacement control means is operable in response to a highest of the discharge pressures in said plural fluid discharge ports and a highest of the load pressures in said plural actuators for controlling discharge fluid pressure of said variable displacement hydraulic pump unit.

* * * * *